US007331734B1

(12) United States Patent
Gallop

(10) Patent No.: US 7,331,734 B1
(45) Date of Patent: Feb. 19, 2008

(54) VEHICLE ACCESS CONTROL BOLLARD

(76) Inventor: Craig Stephen Gallop, 15331 Woodside La., Minnetonka, MN (US) 55345

( * ) Notice: Subject to any disclaimer, the term of this patent is extended or adjusted under 35 U.S.C. 154(b) by 212 days.

(21) Appl. No.: 11/286,976

(22) Filed: Nov. 28, 2005

Related U.S. Application Data

(60) Provisional application No. 60/692,340, filed on Jun. 21, 2005.

(51) Int. Cl.
*E01F 9/011* (2006.01)
*E01F 9/013* (2006.01)
*E01F 9/019* (2006.01)

(52) U.S. Cl. ..... 404/11; 404/9

(58) Field of Classification Search ..... 404/6, 404/9–11

See application file for complete search history.

(56) References Cited

U.S. PATENT DOCUMENTS 3,061,960 A * 11/1962 Dull ..... 49/35
4,050,190 A * 9/1977 Mazzone ..... 49/35
5,018,902 A * 5/1991 Miller et al. ..... 404/6
5,441,359 A * 8/1995 Filippi ..... 404/6
5,520,479 A * 5/1996 Hernandez ..... 404/6
5,895,169 A * 4/1999 Holm et al. ..... 404/9
6,345,930 B1 * 2/2002 Mohassel ..... 404/9
6,409,419 B1 * 6/2002 Hernandez ..... 404/6
6,945,730 B1 * 9/2005 Lobban ..... 404/9

* cited by examiner

*Primary Examiner*—Raymond W Addie
(74) *Attorney, Agent, or Firm*—Thomas B. Tate

(57) ABSTRACT

A vehicle access control bollard for path entryways and restricted drives which allows access for approved vehicles through the use of a self-contained interior lowering mechanism. The three-piece bollard comprises a lower section which is concreted below grade, an intermediate section which houses the interior slip-fit hinge lowering assembly, and an upper section that stands vertically or can be lowered to an approximately four and one-half to five inch clearance height to allow approved vehicles to pass over. There are no exterior hinges, locks, or bolts, thereby giving the appearance of a single permanent non-movable bollard.

3 Claims, 6 Drawing Sheets

VEHICLE ACCESS CONTROL BOLLARD

This application claims the benefit of Provisional Application No. 60/692,340, filed Jun. 21, 2005.

BACKGROUND OF THE INVENTION

The field of the invention is vehicle access control bollards.

Most parks, playgrounds, and athletic fields have little in the way of vehicle access control. If there is any security at all, it is an entrance gate having a conventional lock. However, because the person who has the key is not always available when the park is open, often the gate is left open at all times. This can be a problem, particularly if there is a long path leading from the entrance to the public recreational facilities so that the entrance is not visible from those facilities. In that situation unauthorized persons intent on causing mischief can easily drive into the park undetected.

Prior art traffic control bollards are of a two-piece design having only upper and lower sections, in the form of a sleeve that slides free and/or an exterior hinge. No known prior art device exists that has the outward appearance of a solid bollard but can be laid down using an interior mechanism.

SUMMARY OF THE INVENTION

The invention is a three-piece vehicle access control bollard. The lower section is anchored below ground, while the intermediate and upper sections are above ground. The upper section is collapsible when unlocked, so that a vehicle can drive over it as it lies flat upon the ground to gain entrance to the path being guarded. The tilt-down mechanism and the locking mechanism, which requires no key, are internal. Therefore the bollard looks like a solid immovable post when upright.

An advantage of the invention is that authorized persons can gain access to restricted areas by unlocking and releasing the tilt-down mechanism without using keys or special tools. Upon leaving, the bollard can be easily lifted back into position.

Another advantage is that the above-ground sections can be removed to allow snowplows and street cleaners to pass.

DETAILED DESCRIPTION OF THE INVENTION

Figure 1:
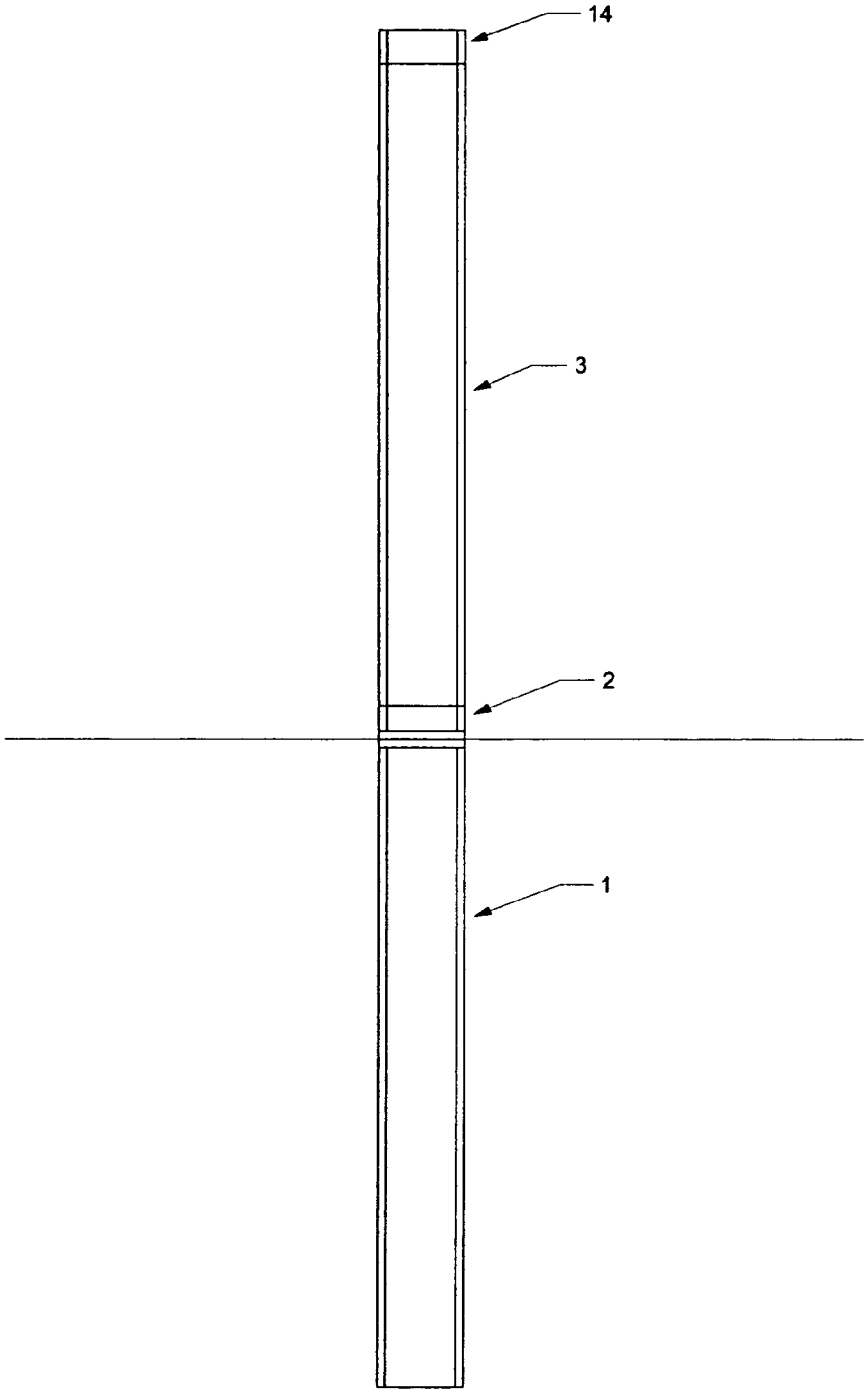
FIG. 1 is a front view of the upright bollard.
Figure 2:
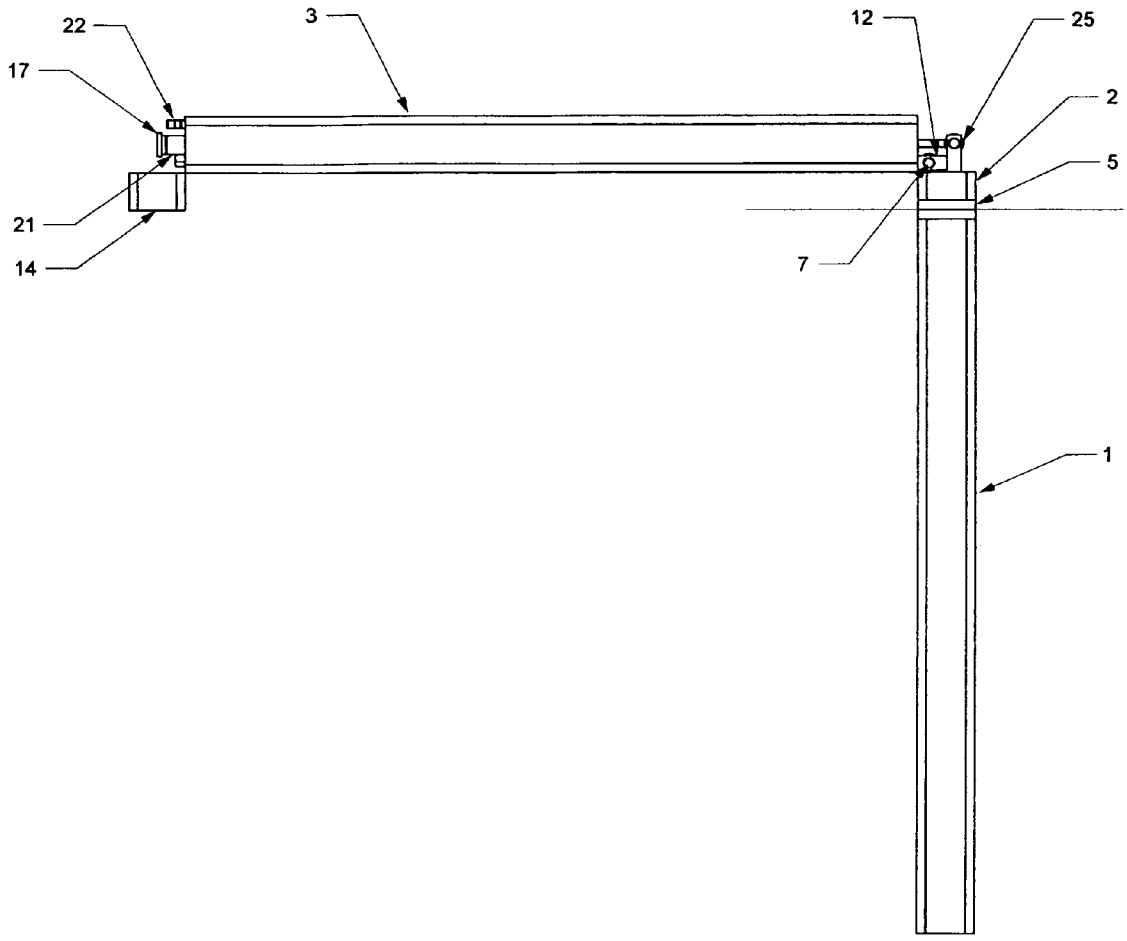
FIG. 2 is a side view of the bollard in lowered position.
Figure 3:
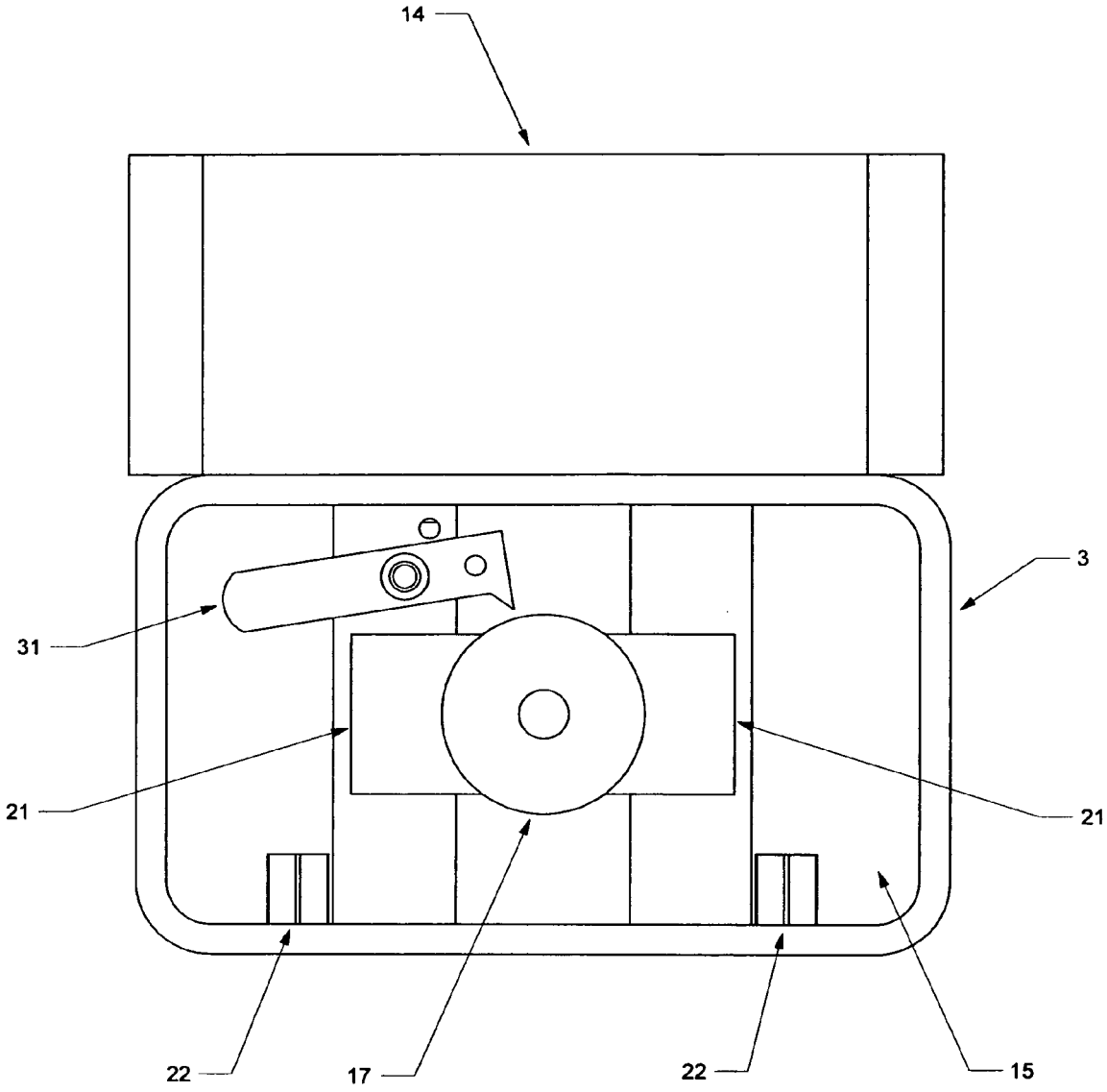
FIG. 3 is a top view with the cap open to reveal the locking mechanism.
Figure 4:
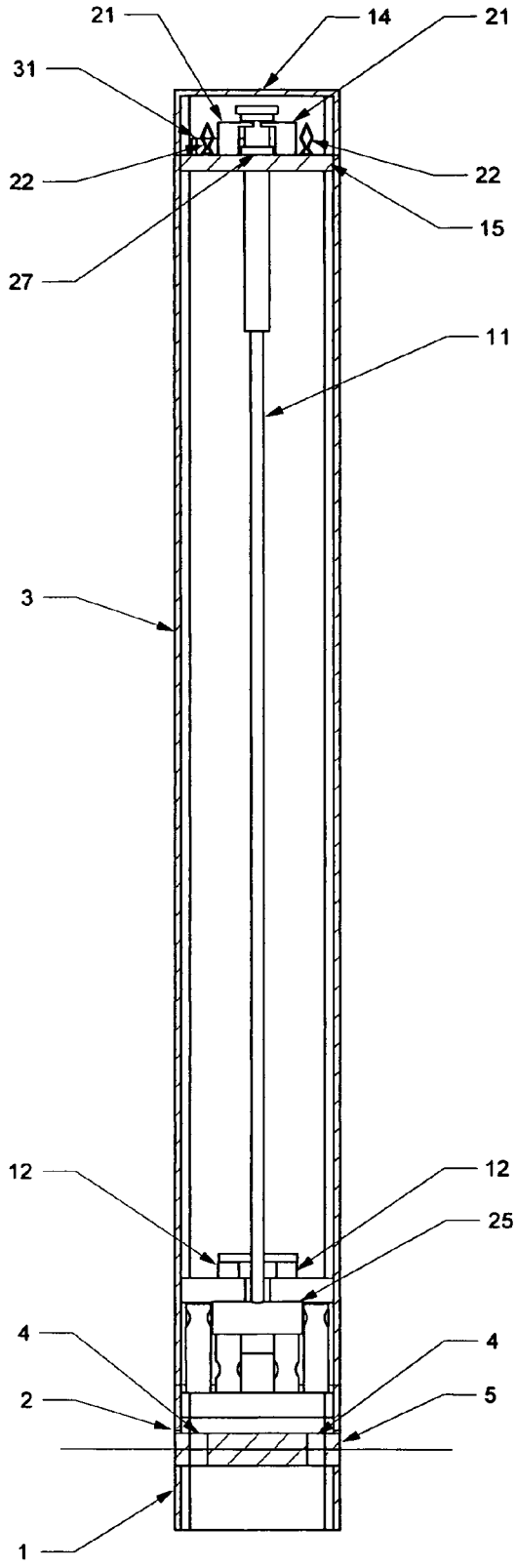
FIG. 4 is a front cutaway view of the upper and intermediate sections to reveal the tilt-down mechanism in the preferred embodiment of the invention.
Figure 5:
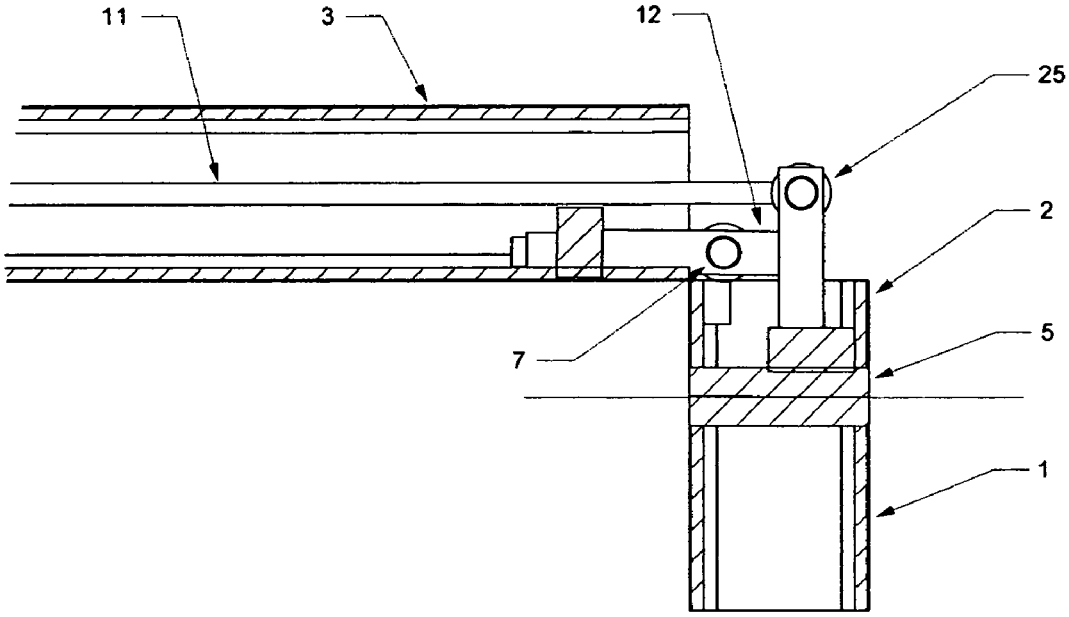
FIG. 5 is a detail view of the sliding hinge and adjacent structures in the preferred embodiment of the invention.
Figure 6:
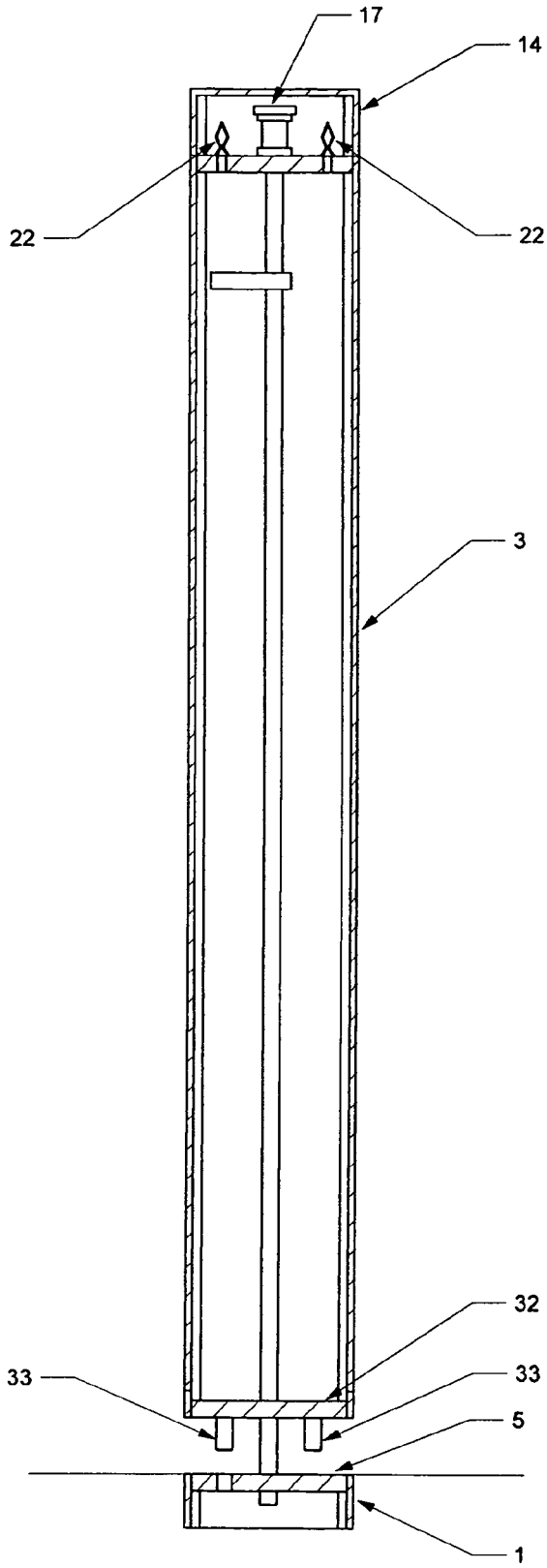
FIG. 6 is a front cutaway view of the upper section to reveal the lowering mechanism in the alternative embodiment of the invention.

The invention is a vehicle access control bollard. The preferred embodiment has three sections: a lower section 1, an intermediate section 2, and an upper section 3. Each of the three sections is a rectangular tubular steel section five inches wide and three inches deep. When the bollard is in locked upright position, the three sections 1, 2, and 3 are locked together so that the bollard appears to be a solid one-piece post.

The lower section 1 is three and one-half feet high and is imbedded in concrete underground so that the top of the lower section 1 is flush with grade. Bolts 4 disposed through openings in a steel plate 5 that divides the lower section 1 from the intermediate section 2 allow the intermediate section 2 and upper section 3 to be removed to allow snowplows and street cleaners to enter the path without damaging the bollard.

The intermediate section 2 is one and one-half to two inches high. The upper section 3 is three and one-half feet high, and is permanently attached to the intermediate section 2 by an internal tilt-down mechanism. The tilt-down mechanism comprises a sliding hinge 7 and threaded pivot locking rod 11. The hinge 7 is permanently attached, as by welding, to the wall of intermediate section 2, and opens backwards. The rod 11, which is welded to a pivot point 25 which is welded to the plate 5, extends upward into the upper section 3 and is held in place within the sides of intermediate section 2 and upper section 3. Guide bars 12 are attached to the inside surface of the upper section 3 and help to line up the upper section 3 to an exacting exterior fit with the intermediate section 2.

A cap 14 is formed at the top of the upper section 3 and is hinged internally so that it can be lifted and opened forward. The rod 11 projects through an opening in the floor 15 of the cap 14 and is topped by an internal locking mechanism into which the rod 11 is screwed. The locking mechanism comprises a knob 17 that can be turned by hand to unlock the tilt-down mechanism and allow the upper section 3 to be lowered straight backwards and to be laid down parallel to the ground. The intermediate section 2 remains upright. The knob 17 will not come off and stays lined up because the locking mechanism has a shoulder 21 that a serrated flange 27 on the bottom of the knob 17 contacts when the knob 17 is raised. Clips 22 hold the cap 14 in place when closed. A safety release mechanism 31 is connected to the shoulder 21 and engages the flange 27 of the knob 17. The safety release mechanism 31 must be engaged in order for the knob 17 to be turned. This is a safety device to keep unauthorized persons from being able to lower the upper section 3 should they be able to get the cap 14 open.

To allow access into a restricted area, an authorized person unlocks the bollard by lifting the cap 14, releasing the safety release 31, turning the knob 17, and lifting the upper section 3 which releases the sliding hinge 7 to allow the upper section 3 to be lowered backward until it is parallel to the ground. In lowered position, there is a vehicle clearance of approximately four and one-half to five inches above grade. When the authorized vehicles have driven over the lowered section and entered the restricted area, the authorized person lifts the upper section 3 back to the upright position, which disengages the sliding hinge 7 and allows the upper section 3 to slide into the upright position, turns the knob 17 in the opposite direction while holding the safety release 31 to lock the bollard into the upright position, and closes the cap 14.

In an alternative embodiment of the invention which has only a lower section 1 and an upper section 3, the rod 11 is welded to the locking mechanism at the top and screwed to a plate 5 which is the top of lower section 1 and also passes through an opening in plate 32 which is the bottom of the upper section 3, and the tilt-down mechanism with sliding hinge is absent. Instead in the alternative embodiment there are three pins 33 that are welded to plate 32 to guide the upper section 3 into alignment with the lower section 1. To lower the upper section 3, unlock and then lift the upper section 3, which frees it from the lower section 1. The upper section 3 can then be laid down in any direction. When the upper section 3 is raised to the upright position, the pins 33 serve as a guide to position the rod 11 and thereby align upper section 3 with lower section 1.

The above descriptions are offered as examples of the best mode for carrying out the invention, and not by way of limitation. It is intended that the scope of the invention include all equivalents that perform the same function in substantially the same way to achieve substantially the same result.

I claim:

1. A vehicle access control bollard comprising:

at least two sections, said sections including a lower section and an upper section, said lower section being positioned below ground and said upper section being positioned above ground when in use, said sections being tubular structures aligned so as to provide the appearance of a solid immovable one-piece post when in upright position;

a hinged cap positioned at the top of said upper section, said cap having a locking mechanism disposed therein, and means for allowing said upper section to lie down parallel to the ground to allow vehicles to pass thereover when said bollard is unlocked Wherein said upper section is raised to release the sliding hinge, thereby permitting the upper section to be laid down parallel to the ground.

2. The vehicle access control bollard of claim 1 wherein said sections include an intermediate section positioned between said upper section and said lower section, and wherein said means for allowing said upper section to lie down parallel to the ground comprises a sliding hinge and pivot rod disposed within said intermediate section to form a tilt-down mechanism, said pivot rod extending into said upper section and connecting to said locking mechanism.

3. The vehicle access control bollard of claim 1 wherein said means for allowing said upper section to lie down parallel to the ground comprises a threaded rod disposed within said upper section, said rod being connected to said locking mechanism.

* * * * *